US009859609B2

(12) United States Patent
Chiang

(10) Patent No.: US 9,859,609 B2
(45) Date of Patent: Jan. 2, 2018

(54) MOBILE COMMUNICATION DEVICE AND REAR COVER THEREOF

(71) Applicant: AUDEN TECHNO CORP., Taoyuan County (TW)

(72) Inventor: Chi-Ming Chiang, Taoyuan County (TW)

(73) Assignee: AUDEN TECHNO CORP., Taoyuan County (TW)

( * ) Notice: Subject to any disclaimer, the term of this patent is extended or adjusted under 35 U.S.C. 154(b) by 0 days.

(21) Appl. No.: 15/145,096

(22) Filed: May 3, 2016

(65) Prior Publication Data

US 2017/0324149 A1 Nov. 9, 2017

(51) Int. Cl.
*H01Q 1/24* (2006.01)

(52) U.S. Cl.
CPC ..... *H01Q 1/243* (2013.01)

(58) Field of Classification Search
None
See application file for complete search history.

(56) References Cited

U.S. PATENT DOCUMENTS

| | | | | |
|---|---|---|---|---|
| 9,203,141 | B1 * | 12/2015 | Su | H01Q 1/243 |
| 9,647,323 | B2 * | 5/2017 | Lee | H01Q 1/243 |
| 2013/0194138 | A1 * | 8/2013 | Hammond | H01Q 1/243 343/702 |
| 2014/0078008 | A1 * | 3/2014 | Kang | H01Q 5/35 343/702 |
| 2016/0182112 | A1 * | 6/2016 | Kim | H01Q 1/243 455/572 |
| 2016/0336643 | A1 * | 11/2016 | Pascolini | H01Q 9/0442 |

* cited by examiner

*Primary Examiner* — Robert Karacsony
(74) *Attorney, Agent, or Firm* — Li & Cai Intellectual Property (USA) Office

(57) ABSTRACT

A rear cover of a mobile communication device includes a metal case, a communication antenna, and an insulating body connecting the metal case and the communication antenna. The metal case has a rear plate and a surrounding plate connected to the edge of the rear plate, and the surrounding plate has two side plates, a top plate, and a bottom plate. A notch is recessed on the edge of the bottom plate. The communication antenna is arranged in the notch, and part of the edge of the communication antenna faces toward the edge of the notch. A slot is recessed on the part of the edge of the communication antenna. The insulating body connects the part of the edge of the communication antenna and the edge of the notch, such that the communication antenna is electrically isolated from the metal case by the insulating body.

9 Claims, 7 Drawing Sheets

MOBILE COMMUNICATION DEVICE AND REAR COVER THEREOF

BACKGROUND OF THE INVENTION

1. Field of the Invention

The instant invention relates to a communication device; in particular, to a mobile communication device and a rear cover thereof.

2. Description of Related Art

The conventional mobile communication device is provided with a rear cover made of metal. The rear cover includes a rear plate and a surrounding plate integrally connected to the edge of the rear plate, and the rear plate has at least one slot for an antenna module and a plurality of mating holes for functional components (e.g., camera, connector, and so on). Specifically, the slot of the rear plate is formed to be a resonant chamber for the antenna module, and the antenna module is not entirely covered by the rear plate but can still emit a signal. In addition, the slot of the rear plate is formed by an additional process, and the rear plate needs to fill plastic material into the slot for maintaining the appearance of the rear plate.

SUMMARY OF THE INVENTION

The instant disclosure provides a mobile communication device and a rear cover thereof for effectively improving the problem generated from the conventional mobile communication device.

The instant disclosure provides a mobile communication device, comprising: an assembly, comprising: a frame; a speaking module and a listening module respectively disposed on two opposite portions of the frame; a circuit board disposed on the frame; and a connector mounted on the circuit board and arranged adjacent to the speaking module; and a rear cover detachably disposed on the frame to shield the circuit board, comprising: a metal case having a rear plate and a surrounding plate connected to an edge of the rear plate, wherein a notch is recessed on an edge of the surrounding plate arranged away from the listening module, and the notch exposes an inserting opening of the connector from the metal case; a communication antenna operable in a high-frequency mode or a low-frequency mode, wherein the communication antenna is arranged in the notch, a first edge portion of the communication antenna is arranged adjacent to an inner wall of the surrounding plate defining the notch, a second edge portion of the communication antenna is arranged adjacent to the connector, a slot is recessed on the second edge portion, exposing at least part of the inserting opening of the connector from the communication antenna; and an insulating body connecting the inner wall and the first and second edge portions of the communication antenna, such that the communication antenna is electrically isolated from the metal case by the insulating body.

The instant disclosure also provides a rear cover of a mobile communication device, comprising: a metal case having a rear plate and a surrounding plate connected to an edge of the rear plate, wherein a notch is recessed on an edge of the surrounding plate arranged away from the rear plate; a communication antenna operable in a high-frequency mode or a low-frequency mode, wherein the communication antenna is arranged in the notch, a first edge portion of the communication antenna is arranged adjacent to an inner wall of the surrounding plate defining the notch, a slot is recessed on a second edge portion of the surrounding plate; and an insulating body connecting the inner wall and the first and second edge portions of the communication antenna, such that the communication antenna is electrically isolated from the metal case by the insulating body.

In summary, the mobile communication device of the instant disclosure is provided with the communication antenna, which is arranged on the bottom portion of the surrounding plate by using the insulating body, so the rear plate does not influence the operating of the communication antenna, and the rear plate of the metal cover can be prepared without any additional processing for the communication antenna.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Please refer to FIGS. 1 through 4 and FIG. 7, which show an embodiment of the instant disclosure. References are hereunder made to the detailed descriptions and appended drawings in connection with the instant invention. However, the appended drawings are merely shown for exemplary purposes, rather than being used to restrict the scope of the instant invention.

Figure 1:
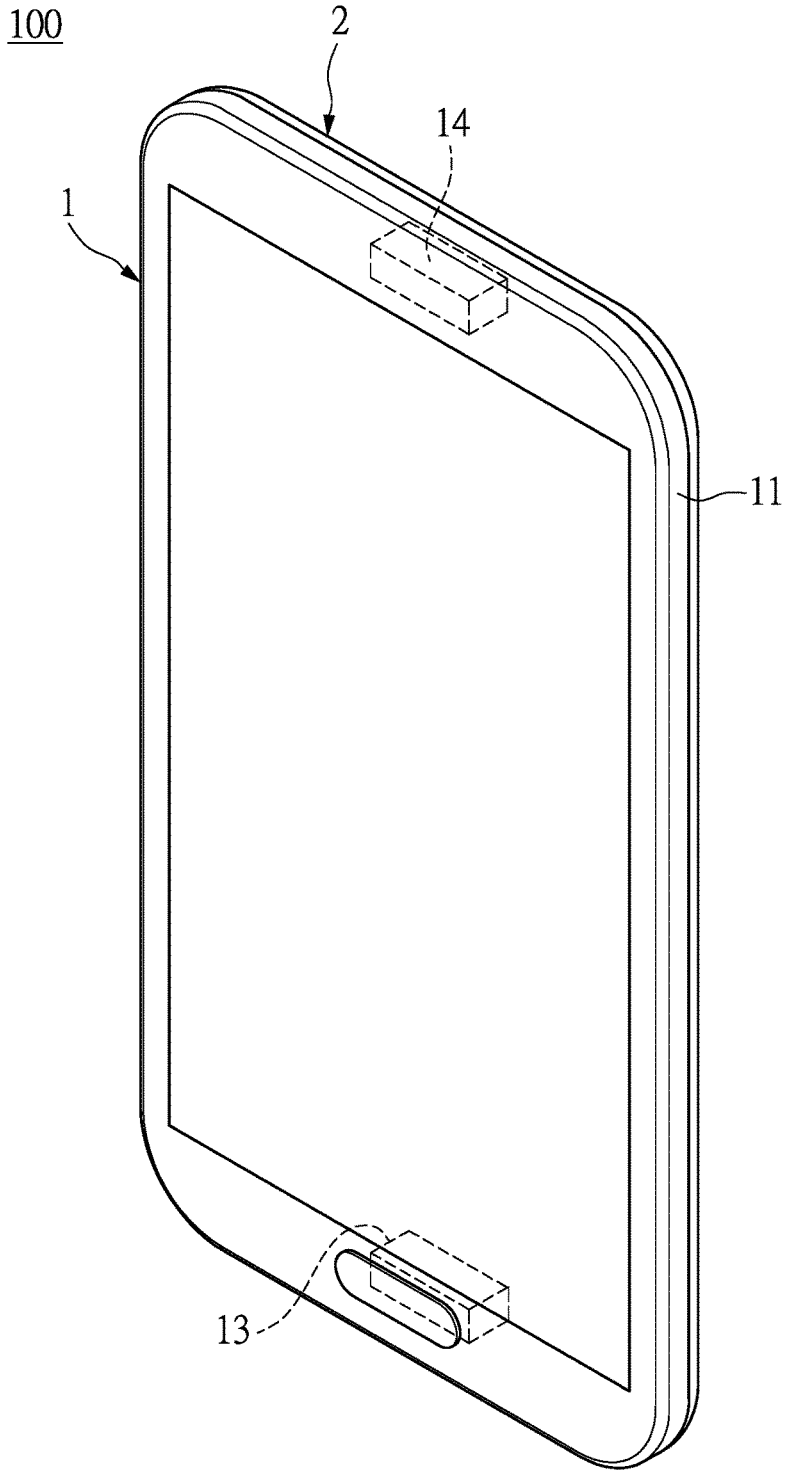
FIG. 1 is a perspective view showing a mobile communication device according to the instant disclosure.
Figure 2:
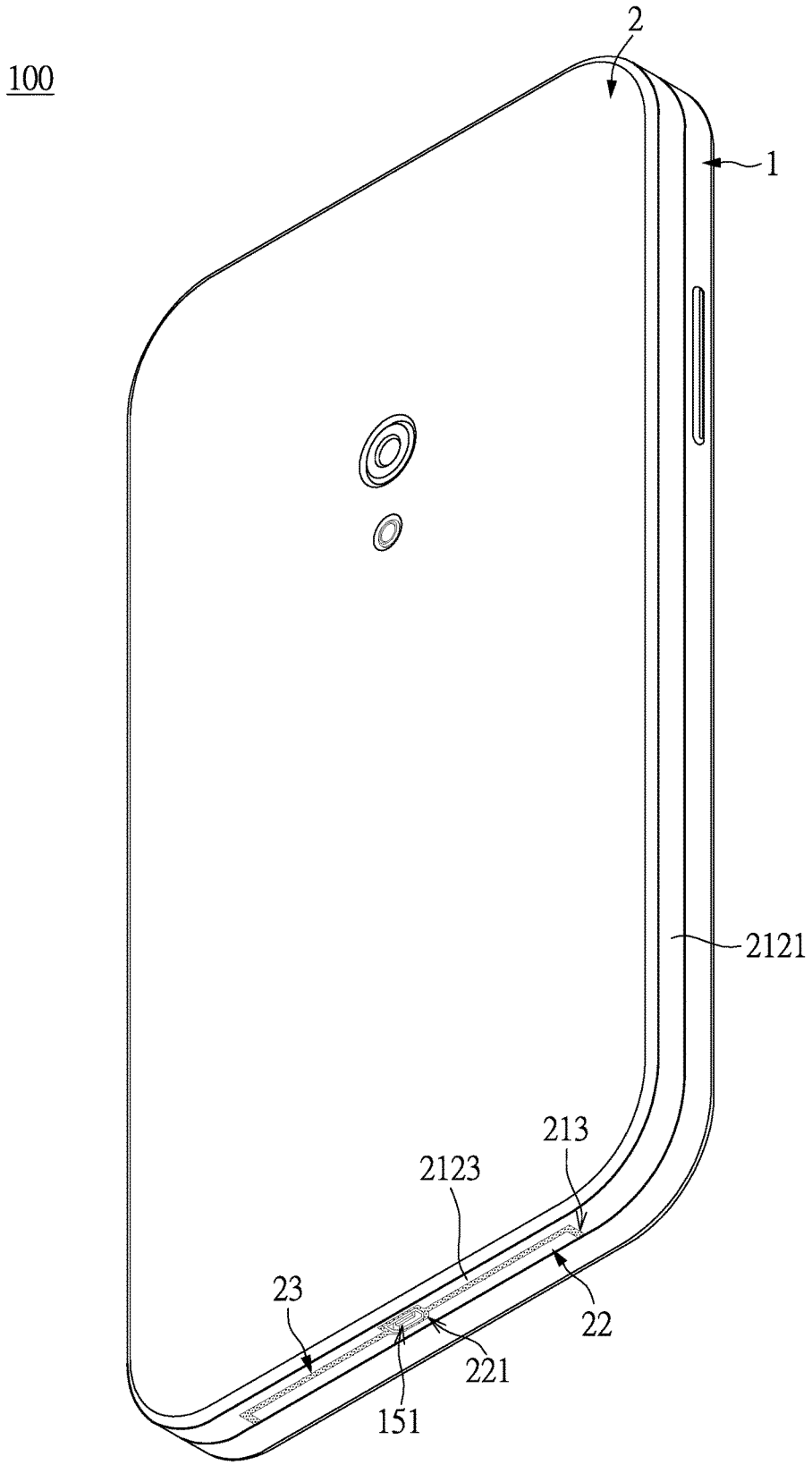
FIG. 2 is a perspective view showing the mobile communication device from another perspective.
Figure 3:
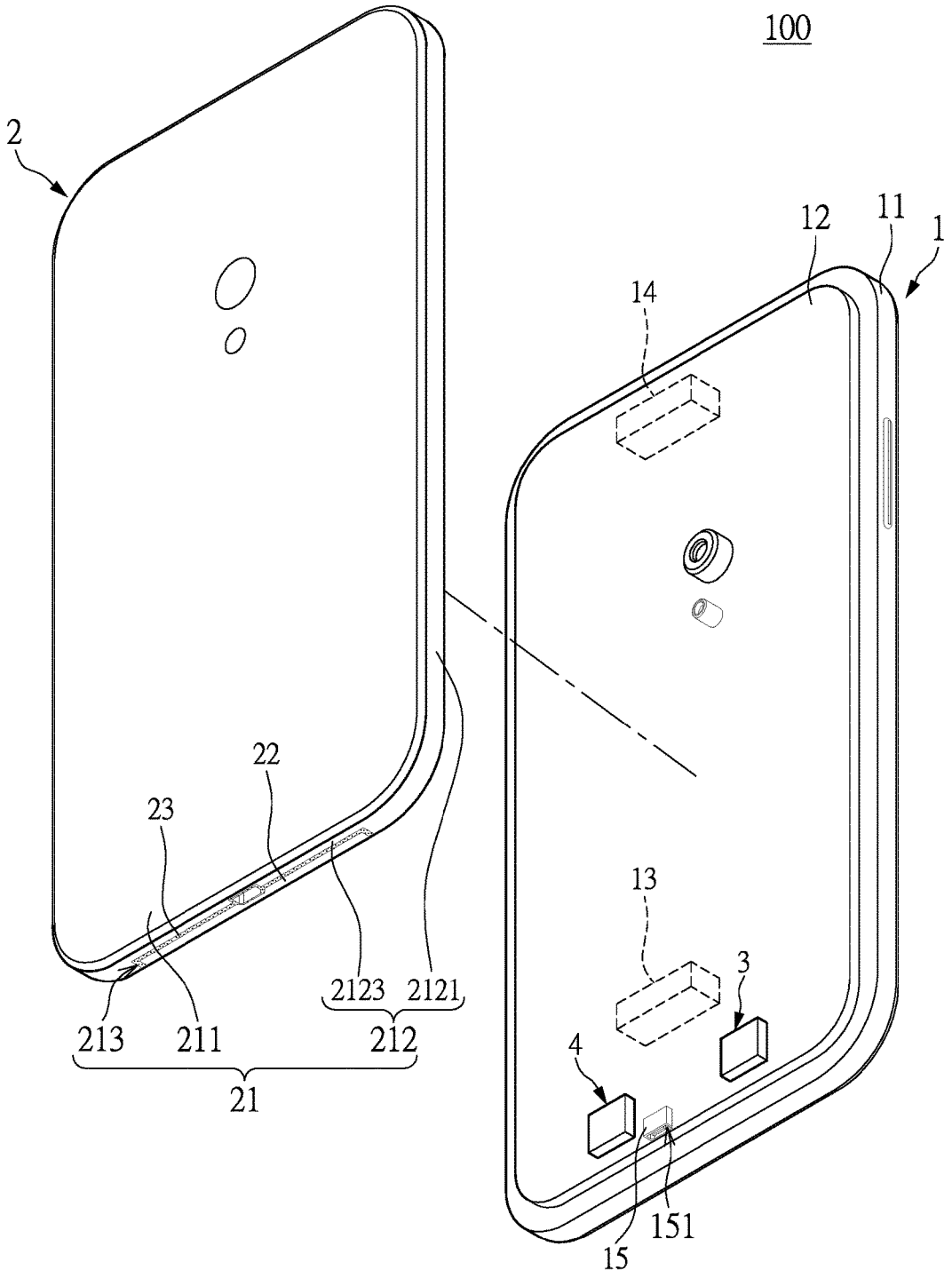
FIG. 3 is an exploded view of FIG. 2.

Please refer to FIGS. 1 through 3, which show a mobile communication device 100 (e.g., smart phone) comprising an assembly 1, a rear cover 2 detachably installed on the assembly 1, a high-frequency switch 3, and a low-frequency switch 4. The high-frequency switch 3 and the low-frequency switch 4 are installed in the assembly 1.

The assembly 1 includes a frame 11, a circuit board 12 mounted on the frame 11, a speaking module 13 and a listening module 14 respectively arranged at two opposite portions of the frame 11, and a connector 15 mounted on the circuit board 12 and arranged adjacent to the speaking module 13. It should be noted that the assembly 1 also includes a display panel (not labeled), a battery module (not shown), and so on, but the instant embodiment does not discuss the construction of the assembly 1 in detail.

Specifically, the contour of the frame 11 has an approximately rectangular shape, and the frame 11 is preferably made of insulating material. The frame 11 in the instant embodiment is configured for providing a supporting function, and the construction of the frame 11 is not limited to the instant embodiment. The circuit board 2 is disposed on the frame 11, and each electronic component of the mobile communication device 100 in the instant embodiment is electrically connected to the circuit board 2 directly or indirectly. The contour of the circuit board 12 is smaller than the contour of the frame 11. The speaking module 13 and the listening module 14 are electrically connected to the circuit board 12 and are respectively arranged close to the top portion and the bottom portion of the frame 11. The connector 15 is fixed on the bottom portion of the circuit board 12, and the type of the connector 15 is not limited to the instant embodiment. In addition, a plurality of functional components (not labeled, such as camera, flasher, and switch) are disposed on the circuit board 12, but the instant disclosure is not limited thereto.

Figure 4:
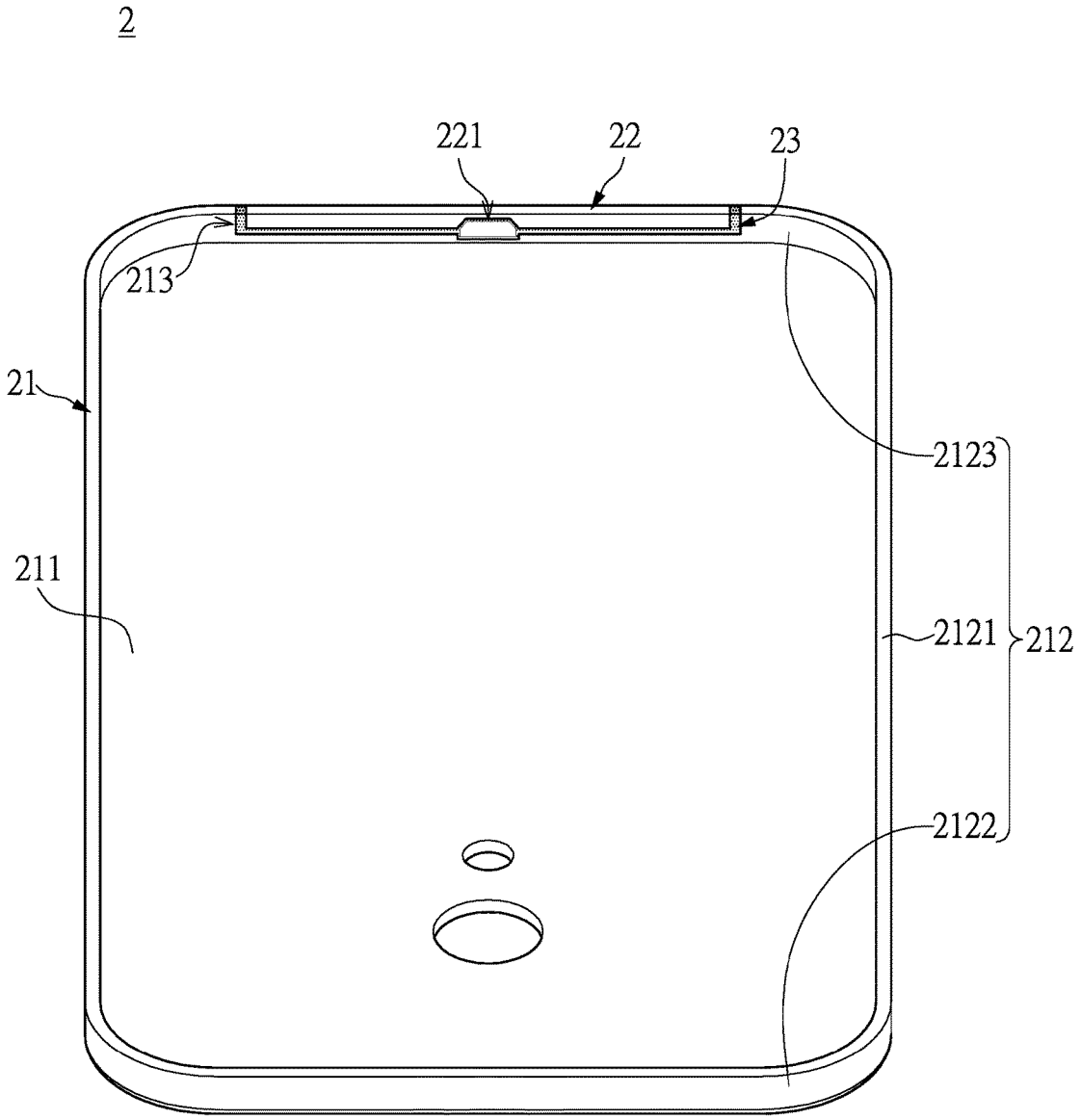
FIG. 4 is a perspective view showing the rear cover of the mobile communication device.

As shown in FIGS. 3 and 4, the rear cover 2 is detachably connected to the frame 11 to shield the circuit board 12, and an inserting opening 151 of the connector 15 is exposed from the rear cover 2. The rear cover 2 includes a metal case 21, a communication antenna 22, and an insulating body 13 seamlessly connecting the metal case 21 and the communication antenna 22. Specifically, the metal case 21 has a rear plate 211 and a surrounding plate 212 integrally connected to an edge of the rear plate 211. An elongated notch 213 is recessed on a bottom portion of the edge of the surrounding plate 212, which is arranged close to the speaking module 13 and away from the listening module 14. The surrounding plate 212 has two opposite side plates 2121, a top plate 2122, and a bottom plate 2123. The speaking module 13 is arranged away from the top plate 2122 and is arranged close to the bottom plate 2123. The notch 213 is recessed on an edge of the bottom plate 2123 arranged away from the rear plate 211, and the notch 213 exposes the inserting opening 151 of the connector 15 from the metal case 21.

The rear plate 211 of the metal case 21 in the instant embodiment is configured without any plastic formed thereon, and the rear plate 211 is formed without any slot corresponding in a structural and/or electrical relationship to the communication antenna 22 or the other antenna (e.g., GPS antenna, Wi-Fi antenna). In other words, the rear plate 211 of the metal case 21 only has some mating holes (not labeled) that respectively correspond in position to the functional components (i.e., camera and flasher).

The communication antenna 22 is operable in a high-frequency mode or a low-frequency mode, and the communication antenna 22 in the instant embodiment is a GSM antenna. In other words, the communication antenna 22 in the instant embodiment is not a GPS antenna or a Wi-Fi antenna. The communication antenna 22 having an elongated shape is arranged in the notch 213 of the metal case 21, and a first edge portion of the communication antenna 22 is arranged adjacent to an inner wall of the surrounding plate 212 defining the notch 213. Specifically, a second edge portion of the communication antenna 22 is arranged adjacent to the connector 15, and a slot 221 is recessed on the second edge portion. The slot 221 is corresponding (i.e., identical) in shape to part of the inserting opening 151 of the connector 15, and the slot 221 exposes at least part of the inserting opening 151 of the connector 15 from the communication antenna 22.

Figure 7:
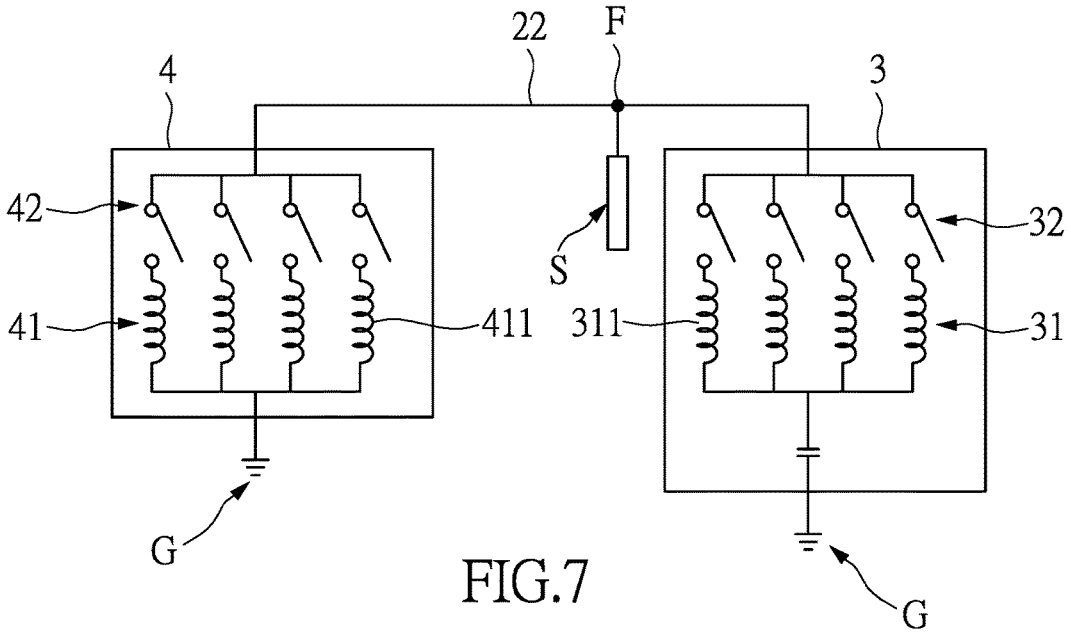
FIG. 7 is a functional block view of the mobile communication device of the instant disclosure.

Moreover, the rear cover 2 is installed on the frame 11 of the assembly 1, and the communication antenna 22 is electrically connected to a signal feeding circuit S and a grounding circuit G of the circuit board 12 by any suitable manner. For example, as shown in FIG. 7, the signal feeding circuit S of the circuit board 12 can be electrically connected to a feeding point F of the communication antenna 22 by using an elastic sheet (not shown). The grounding circuit G of the circuit board 12 is electrically connected to the high-frequency switch 3 and the low-frequency switch 4, and the high-frequency switch 3 and the low-frequency switch 4 are electrically connected to two grounding points of the communication antenna 22 by using two elastic sheets (not shown).

The insulating body 23 connects the inner wall of the metal case 21, which defines the notch 213, and the first and second edge portions of the communication antenna 22, such that the communication antenna 22 is electrically isolated from the metal case 21 by the insulating body 23. A thickness of the communication antenna 22, a thickness of the insulating body 23, and a thickness of the surrounding plate 212 are approximately the same, so the inner surface and the outer surface of the rear cover 2 are smooth without any protrusion. Moreover, a third edge portion of the communication antenna 22 (i.e., the top edge portion of the communication antenna 22 shown in FIG. 4), which is not connected to the insulating body 23, is aligned with the edge of the surrounding plate 212 arranged away from the rear plate 211. The communication antenna 22 fills at least 80% of a space, defined by the notch 213.

In addition, the communication antenna 22 in the instant embodiment is arranged on the bottom portion (i.e., the bottom plate 2123) of the rear cover 2, but the length, shape, and position of the communication antenna 22 can be changed and are not limited to FIG. 2. For example, the instant disclosure further provides two variations respectively shown in FIGS. 5 and 6.

Figure 5:
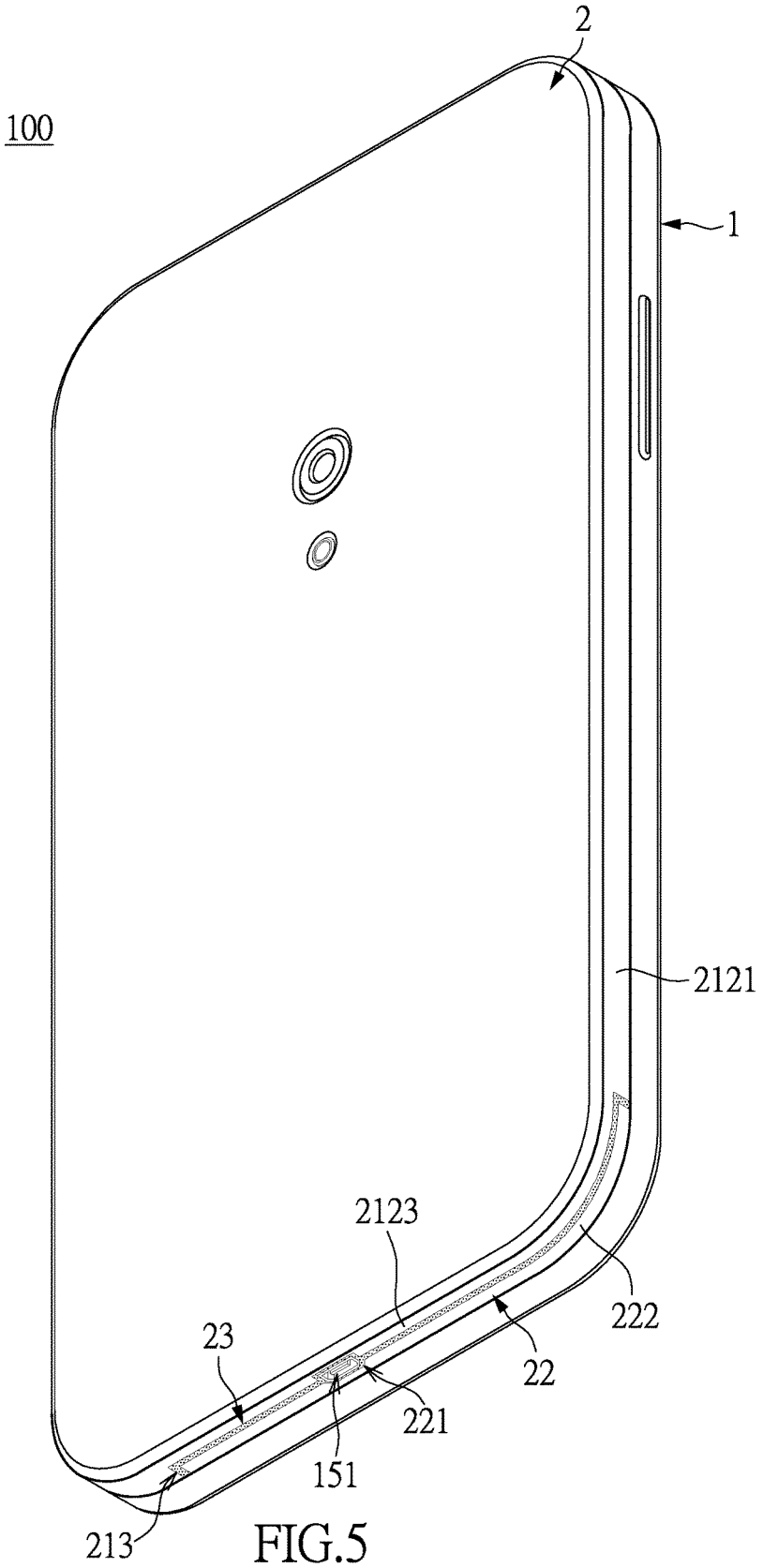
FIG. 5 is a perspective view showing a mobile communication device according to another embodiment of the instant disclosure.

As shown in FIG. 5, the notch 213 is recessed on an edge of the bottom plate 2123 and an edge of one of the side plates 2121, which are arranged away from the rear plate 211. The communication antenna 22 fills at least 80% of a space defined by the notch 213. The communication antenna 22 has a curved portion 222 at approximately 90 degrees, and the curved portion 222 is arranged in a position corresponding to a connecting portion of the bottom plate 2123 and one of the side plates 2121.

Figure 6:
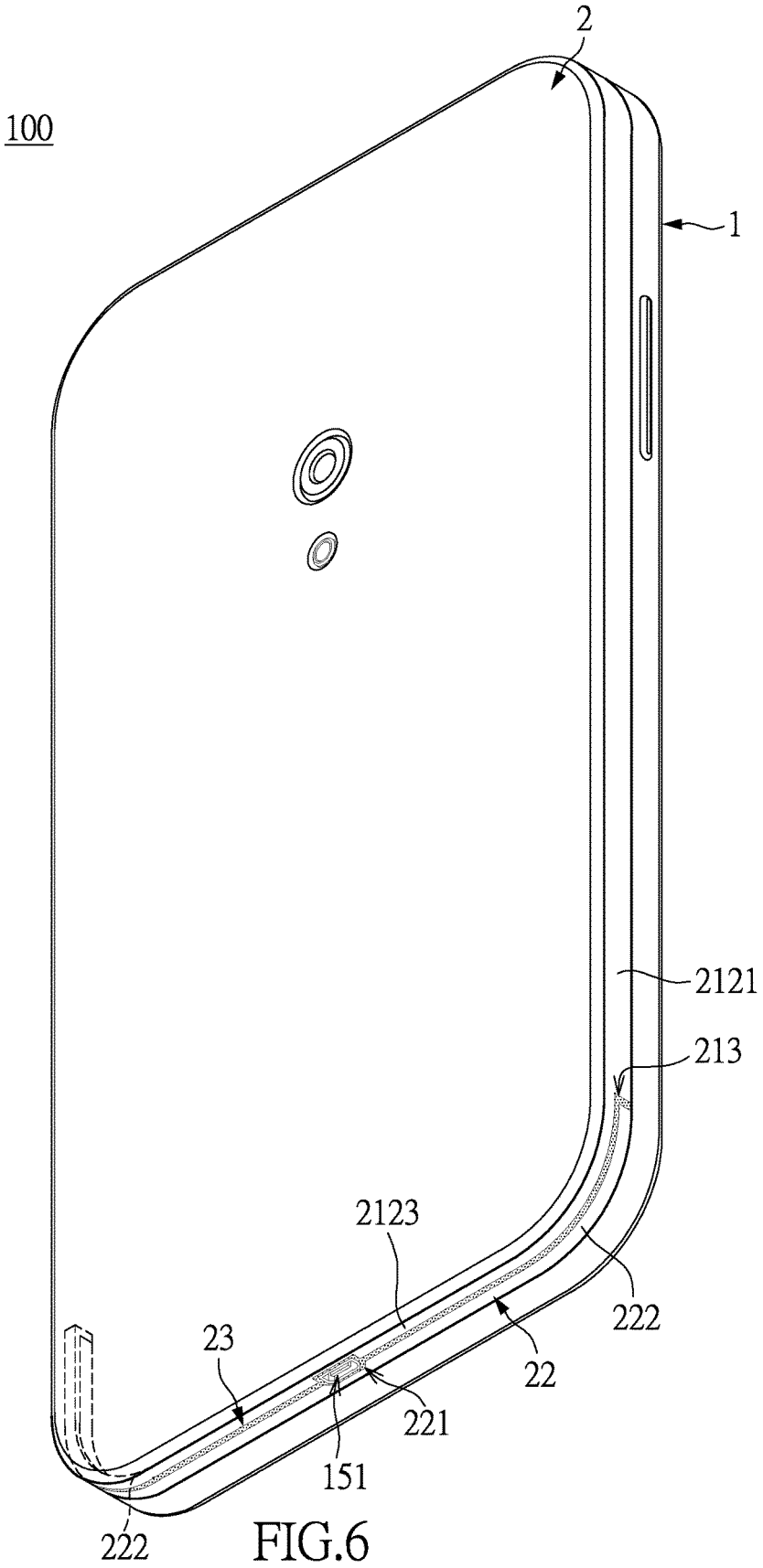
FIG. 6 is a perspective view showing a mobile communication device according to the other embodiment of the instant disclosure.

As shown in FIG. 6, the notch 213 is recessed on an edge of the bottom plate 2123 and an edge of each side plate 2121, which are arranged away from the rear plate 211. The communication antenna 22 is filled in at least 80% of a space defined by the notch 213. The communication antenna 22 has two curved portions 222 each at approximately 90 degrees, and the two curved portions 222 are arranged in a position corresponding to two corners of the surrounding plate 212, which are the two connecting portions of the bottom plate 2123 and the side plates 2121.

As shown in FIGS. 3 and 7, the high-frequency switch 3 and the low-frequency switch 4 are respectively arranged at two opposite sides of the connector 15. The high-frequency switch 3 and the low-frequency switch 4 in the instant embodiment are directly mounted on the circuit board 12 and are electrically connected to the grounding circuit G of the circuit board 12, but are not limited thereto.

Specifically, the high-frequency switch 3 has a high-frequency mating circuit 31 and a high-frequency switching circuit 32. The high-frequency mating circuit 31 has a plurality of high-frequency sub-circuits 311. An end of each high-frequency sub-circuit 311 is electrically connected to the grounding circuit G of the circuit board 12, and the other end of each high-frequency sub-circuit 311 is formed as a high-frequency contact (not labeled). The high-frequency switching circuit 32 is electrically connected to the communication antenna 22. The high-frequency switching circuit 32 is selectively connected to at least one of the high-frequency contacts so as to match an impedance of the communication antenna 22 to an impedance of the connected high-frequency sub-circuit 311, thereby adjusting a center frequency of the high-frequency mode.

In other words, the high-frequency sub-circuits 311 in the instant embodiment respectively have different inductances, so the high-frequency sub-circuits 311 can respectively adjust the center frequency of the high-frequency mode to be a different value when the impedance of the communication antenna 22 is matched to that of different high-frequency sub-circuits 311. Accordingly, the inductance (or capacitance) of the high-frequency mating circuit 31 can be changed to adjust the center frequency of the high-frequency mode.

In addition, the high-frequency mode has a frequency band of 1700~2700 MHz, that is to say, the center frequency of the high-frequency mode can be adjusted between 1700~2700 MHz by using the high-frequency switch 3. Moreover, an efficiency of the communication antenna 22 in the high-frequency mode is equal to or larger than −5 dB.

The low-frequency switch 4 has a low-frequency mating circuit 41 and a low-frequency switching circuit 42. The low-frequency mating circuit 41 has a plurality of low-frequency sub-circuits 411. An end of each low-frequency sub-circuit 411 is electrically connected to the grounding circuit G of the circuit board 12, and the other end of each low-frequency sub-circuit 411 is formed as a low-frequency contact (not labeled). The low-frequency switching circuit 42 is electrically connected to the communication antenna 22. The low-frequency switching circuit 42 is selectively connected to at least one of the low-frequency contacts so as to match an impedance of the communication antenna 22 to an impedance of the connected low-frequency sub-circuit 411, thereby adjusting a center frequency of the low-frequency mode.

In other words, the low-frequency sub-circuits 411 in the instant embodiment respectively have different inductances, so the low-frequency sub-circuits 411 can respectively adjust the center frequency of the low-frequency mode to be a different value when the impedance of the communication antenna 22 is matched to that of different low-frequency sub-circuits 411. Accordingly, the inductance (or capacitance) of the low-frequency mating circuit 41 can be changed to adjust the center frequency of the low-frequency mode.

In addition, the low-frequency mode has a frequency band of 698~960 MHz, that is to say, the center frequency of the high-frequency mode can be adjusted between 698~960 MHz by using the low-frequency switch 4. Moreover, an efficiency of the communication antenna 22 in the low-frequency mode is equal to or larger than −7 dB.

As shown in FIG. 7, the high-frequency switch 3 (or the low-frequency switch 4) in the instant embodiment is connected to one of the high-frequency contacts (or one of the low-frequency contacts), but is not limited thereto. For example, in a non-shown embodiment, the high-frequency switch 3 (or the low-frequency switch 4) is connected to at least two of the high-frequency contacts (or at least two of the low-frequency contacts) for adjusting the center frequency of the high-frequency mode (or the center frequency of the low-frequency mode).

The Possible Effect of the Instant Disclosure

In summary, the mobile communication device of the instant disclosure is provided with the communication antenna, which is arranged on the bottom portion of the surrounding plate by using the insulating body, so the rear plate does not influence the operating of the communication antenna, and the rear plate of the metal cover can be prepared without any additional process for the communication antenna. Moreover, the communication antenna can be provided with at least one curved portion for matching the signal transmission request in the high-frequency mode and the low-frequency mode.

In addition, the mobile communication device of the instant disclosure is provided with the high-frequency switch and the low-frequency switch for adjusting the center frequency of the high-frequency mode and the center frequency of the low-frequency mode, thus the communication antenna can be arranged on the surrounding plate by adapting a simple construction.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A mobile communication device, comprising:

an assembly, comprising:

a frame;

a speaking module and a listening module respectively disposed in two opposite portions of the frame;

a circuit board disposed on the frame; and a connector mounted on the circuit board and arranged adjacent to the speaking module; and a rear cover detachably disposed on the frame to shield the circuit board, comprising:

a metal case having a rear plate and a surrounding plate connected to an edge of the rear plate, wherein a notch is recessed on an edge of the surrounding plate arranged away from the listening module, and the notch exposes an inserting opening of the connector from the metal case;

a communication antenna operable in a high-frequency mode or a low-frequency mode, wherein the communication antenna is arranged in the notch, a first edge portion of the communication antenna is arranged adjacent to an inner wall of the surrounding plate defining the notch, a second edge portion of the communication antenna is arranged adjacent to the connector, a slot is recessed on the second edge portion, exposing at least part of the inserting opening of the connector from the communication antenna; and an insulating body connecting the inner wall and the first and second edge portions of the communication antenna, such that the communication antenna is electrically isolated from the metal case by the insulating body, wherein the surrounding plate has two opposite side plates, a top plate, and a bottom plate; the speaking module is arranged away from the top plate and close to the bottom plate, the notch is recessed on an edge of the bottom plate arranged away from the rear plate, and the communication antenna fills at least 80% of a space defined by the notch.

2. The mobile communication device as claimed in claim 1, further comprising a high-frequency switch, wherein the high-frequency switch comprises:

a high-frequency mating circuit having a plurality of high-frequency sub-circuits, wherein an end of each high-frequency sub-circuit is electrically connected to a grounding circuit of the circuit board, and the other end of each high-frequency sub-circuit is formed as a high-frequency contact; and a high-frequency switching circuit electrically connected to the communication antenna, wherein the high-frequency switching circuit is selectively connected to at least one of the high-frequency contacts so as to match an impedance of the communication antenna to an impedance of the connected high-frequency sub-circuit, thereby adjusting a center frequency of the high-frequency mode.

3. The mobile communication device as claimed in claim 2, further comprising a low-frequency switch, wherein the low-frequency switch comprises:

a low-frequency mating circuit having a plurality of low-frequency sub-circuits, wherein an end of each low-frequency sub-circuit is electrically connected to the grounding circuit of the circuit board, and the other end of each low-frequency sub-circuit is formed as a low-frequency contact; and a low-frequency switching circuit electrically connected to the communication antenna, wherein the low-frequency switching circuit is selectively connected to at least one of the low-frequency contacts so as to match an impedance of the communication antenna to an impedance of the connected low-frequency sub-circuit, thereby adjusting a center frequency of the low-frequency mode.

4. The mobile communication device as claimed in claim 3, wherein the high-frequency switch and the low-frequency switch are respectively arranged at two opposite sides of the connector.

5. The mobile communication device as claimed in claim 3, wherein the high-frequency mode has a frequency band of 1700~2700 MHz, and an efficiency of the communication antenna in the high-frequency mode is equal to or larger than −5 dB; the low-frequency mode has a frequency band of 698~960 MHz, and an efficiency of the communication antenna in the low-frequency mode is equal to or larger than −7 dB.

6. The mobile communication device as claimed in claim 1, wherein a third edge portion of the communication antenna is not connected to the insulating body and is aligned with an edge of the surrounding plate arranged away from the rear plate; the rear plate is configured without any plastic formed thereon, and the rear plate is formed without any slot corresponding in a structural and/or electrical relationship to the communication antenna.

7. The mobile communication device as claimed in claim 6, wherein a thickness of the communication antenna, a thickness of the insulating body, and a thickness of the surrounding plate are approximately the same, and the shape of the slot is identical to part of the shape of the inserting opening of the connector.

8. A rear cover of a mobile communication device, comprising:

a metal case having a rear plate and a surrounding plate connected to an edge of the rear plate, wherein a notch is recessed on an edge of the surrounding plate arranged away from the rear plate;

a communication antenna operable in a high-frequency mode or a low-frequency mode, wherein the communication antenna is arranged in the notch, a first edge portion of the communication antenna is arranged adjacent to an inner wall of the surrounding plate defining the notch, a slot is recessed on a second edge portion of the communication antenna; and an insulating body connecting the inner wall and the first and second edge portions of the communication antenna, such that the communication antenna is electrically isolated from the metal case by the insulating body, wherein the surrounding plate has two opposite side plates, a top plate, and a bottom plate; the notch is recessed on an edge of the bottom plate arranged away from the rear plate, and the communication antenna fills at least 80% of a space defined by the notch.

9. A mobile communication device, comprising:

an assembly, comprising:

a frame;

a speaking module and a listening module respectively disposed in two opposite portions of the frame;

a circuit board disposed on the frame; and a connector mounted on the circuit board and arranged adjacent to the speaking module; and a rear cover detachably disposed on the frame to shield the circuit board, comprising:

a metal case having a rear plate and a surrounding plate connected to an edge of the rear plate, wherein a notch is recessed on an edge of the surrounding plate arranged away from the listening module, and the notch exposes an inserting opening of the connector from the metal case;

a communication antenna operable in a high-frequency mode or a low-frequency mode, wherein the communication antenna is arranged in the notch, a first edge portion of the communication antenna is arranged adjacent to an inner wall of the surrounding plate defining the notch, a second edge portion of the communication antenna is arranged adjacent to the connector, a slot is recessed on the second edge portion, exposing at least part of the inserting opening of the connector from the communication antenna; and an insulating body connecting the inner wall and the first and second edge portions of the communication antenna, such that the communication antenna is electrically isolated from the metal case by the insulating body, wherein the surrounding plate has two opposite side plates, a top plate, and a bottom plate; the speaking module is arranged away from the top plate and close to the bottom plate, the notch is recessed on an edge of the bottom plate and an edge of at least one of the side plates arranged away from the rear plate, the communication antenna fills at least 80% of a space defined by the notch, the communication antenna has at last one curved portion having an approximately 90 degrees, and the curved portion is correspondingly arranged in position to a connecting portion of the bottom plate and the at least one of the side plates.

* * * * *